US005620180A

United States Patent [19]

Hong

[11] Patent Number: 5,620,180

[45] Date of Patent: Apr. 15, 1997

[54] GRIP OF BADMINTON RACKET

[76] Inventor: Arthur Hong, No. 96, Sec. 4, Pei-Ping Rd., Taichung City, Taiwan

[21] Appl. No.: 597,987

[22] Filed: Feb. 7, 1996

[51] Int. Cl.[6] ..... A63B 49/08

[52] U.S. Cl. ..... 473/521; 473/538; 473/549

[58] Field of Search ..... 273/73 R, 73 J, 273/75

[56] References Cited

U.S. PATENT DOCUMENTS

| | | | |
|---|---|---|---|
| 4,736,949 | 4/1988 | Muroi | 273/73 J |
| 5,282,618 | 2/1994 | Hong | 273/73 J |
| 5,425,534 | 6/1995 | Chen | 273/73 J |

FOREIGN PATENT DOCUMENTS

| | | | |
|---|---|---|---|
| 2262045 | 6/1993 | United Kingdom | 273/73 J |
| 2264650 | 9/1993 | United Kingdom | 273/73 J |
| 2281039 | 2/1995 | United Kingdom | 273/73 J |

*Primary Examiner*—William E. Stoll
*Attorney, Agent, or Firm*—Browdy and Neimark

[57] ABSTRACT

A badminton racket comprises a head frame, a gut, a shaft and a grip. The grip comprises a main body and a grip portion having a length of 15.5 centimeters or more. The main body is provided in the interior thereof with a slot extending from the free end of the main body in the direction toward the shaft for reducing the weight of the main body so as to cause the center of gravity to move toward the junction between the shaft and the tapered end of the main body of the grip. The tapered end of the main body is provided with a front jacket which is fitted thereover and is provided with a V-shaped cut for forming a receiving space between the front jacket and the above tapered end of the main body. A shock-absorbing body is received in the receiving space such that the tapered end of the shock-absorbing body and the front jacket form together a tapered end of the grip.

1 Claim, 2 Drawing Sheets

GRIP OF BADMINTON RACKET

FIELD OF THE INVENTION

The present invention relates generally to a badminton racket, and more particularly to an improved grip of the badminton racket.

BACKGROUND OF THE INVENTION

In an offensive move of the badminton game, the center of gravity is preferably located on the head frame of the badminton racket. On the other hand, it is desirable that the center of gravity is located on the grip of the badminton racket at the time when the player is engaged in a defensive move. The conventional badminton rackets fall short of these two expectations described above.

SUMMARY OF THE INVENTION

The primary objective of the present invention is to provide a badminton racket with an improved hand grip enabling the player to engage in an offensive move and a defensive move vigorously and effectively.

The objective of the present invention is attained by an improved hand grip of badminton racket. The length of the hand grip is increased such that the overall length of the badminton racket is not increased, and that the length of the flexible portion of the grip is increased, and further that the center of gravity of the grip is relocated toward the head frame of the racket. As a player is engaged in an offensive move, he or she may hold the free end portion of the grip so as to cause the center of gravity to move toward the head frame. On the other hand, when the player is engaged in a defensive move, he or she may hold the portion contiguous to the front jacket located near the junction between the shaft and the grip.

DETAILED DESCRIPTION OF THE INVENTION

Figure 1:
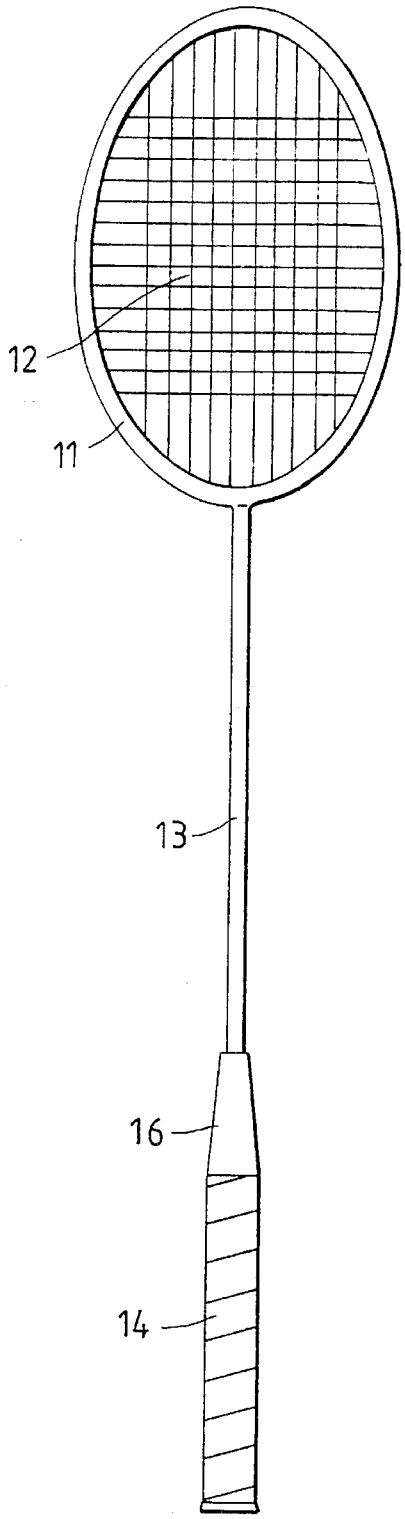
FIG. 1 PRIOR ART
FIG. 1 shows a plan view of a badminton racket of the prior art.

Before describing the features of the present invention, it is desirable that the prior art badminton racket is reviewed briefly. As shown in FIG. 1, the prior art badminton racket 10 has an overall length of 66 centimeters (26 inches) and comprises a head frame 11, a gut 12, a shaft 13 extending from the head frame 11, and a grip 14 having a tapered end which is fastened with the free end of the shaft 13.

Figure 3:
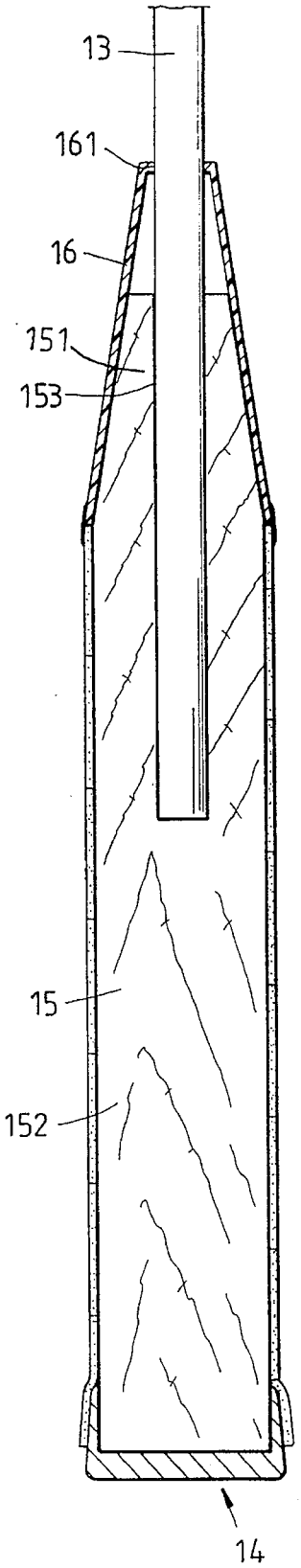
FIG. 3 PRIOR ART
FIG. 3 shows a sectional view of a grip of the prior art badminton racket.

Now referring to FIG. 3 showing a sectional view of the prior art grip 14 which has an overall length of 20 centimeters. The grip 14 comprises a main body 15 having a tapered end portion 151 and a grip 152 having a length of 14.5 centimeters. The tapered end portion 151 has a length of 3.5 centimeters. The main body 15 further has a shaft hole 153 extending from the tapered end portion 151 along the center line of the main body 15 into a predetermined depth of the grip 152 for receiving the shaft 13. A front jacket 16 of a rigid plastic material is fitted over the tapered end portion 151 of the main body 15. The front jacket 16 has an overall length of 5.5 centimeters and a through hole 161 for receiving therein the shaft 13.

The flexibility length of the prior art shaft 13 begins at the tapered end of the front jacket 16. The fixed point of the shaft 13 is located at a point which is 20 centimeters away from the free end of the grip 14.

Figure 2:
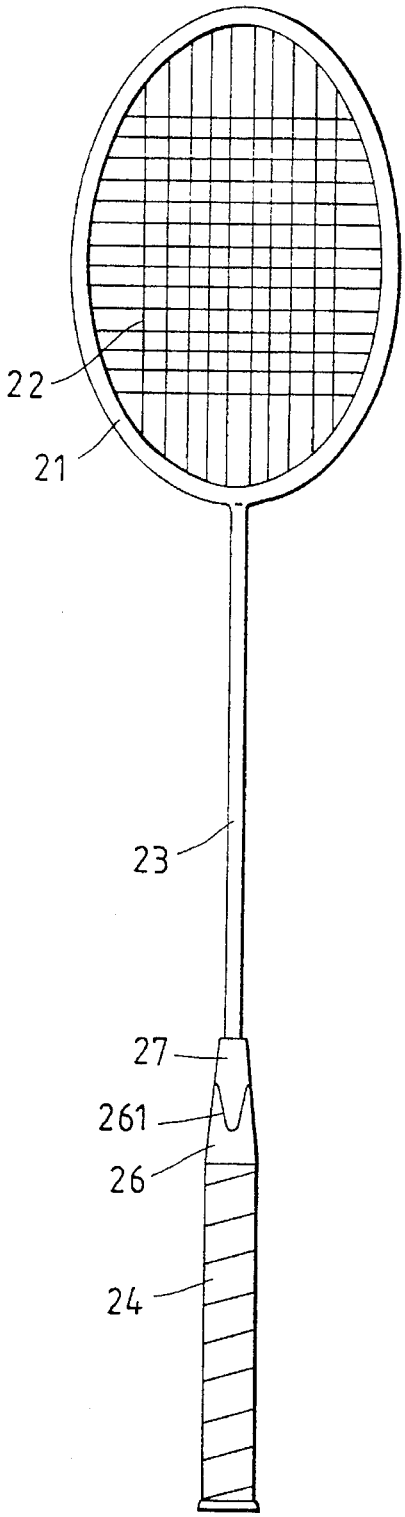
FIG. 2 shows a plan view of a badminton racket of the present invention.

As shown in FIG. 2, a badminton racket 20 of the present invention has an overall length of 66 centimeters and comprises a head frame 21, a gut 22, a shaft 23, and a grip 24. The head frame 21, the gut 22 and the shaft 23 are similar in construction to those of the prior art badminton racket described above.

Figure 4:
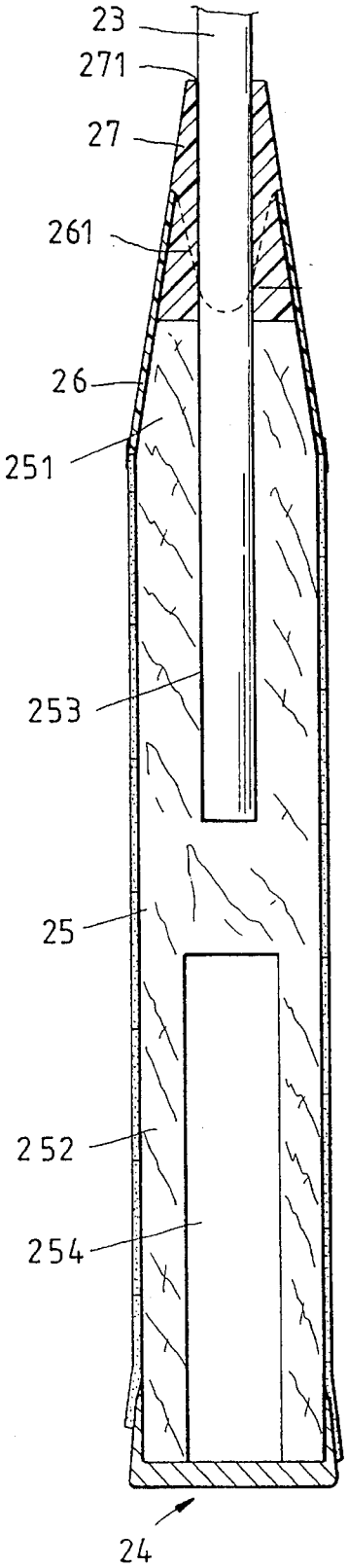
FIG. 4 shows a sectional view of a grip of the badminton racket of the present invention.

As shown in FIG. 4, the grip 24 of the badminton racket 20 of the present invention has an overall length of 21 centimeters, with the overall length of the badminton racket 20 remaining the same as that of the badminton racket 10 of the prior art. In addition, the flexibility length of the shaft 23 of the present invention is not shortened.

The grip 24 of the present invention comprises a main body 25 and a front jacket 26. The main body 25 has a tapered end portion 251, a grip portion 252 and a shaft hole 253. The front jacket 26 of a rigid plastic material is fitted over the tapered end portion 251 of the main body 25. The grip portion 252 of the main body 25 has an overall length of 15.5 centimeters or more and a slot 254 for reducing the weight of the grip portion 252 and causing the center of gravity to move toward the tapered end portion 251 which is shortened to an extent that it can be fitted over with one end portion of the front jacket 26. The front jacket 26 is provided with a V-shaped cut 261 corresponding in location to the longitudinal center line of the gut 22 such that a receiving space is formed between the front jacket 26 and above the end portion 251 of the main body 25. An elastic shock-absorbing body 27 of a tapered construction is received in the receiving space such that the tapered end of the shock-absorbing body 27 is extended beyond the top end of the front jacket 26, and that the tapered end of the shock-absorbing body 27 and the front jacket 26 form together the tapered end of the grip 24. The shock-absorbing body 27 is provided with an axial hole 271 for receiving therein the shaft 23.

The overall length of the hand grip 24, including the shock-absorbing body 27, is 21 centimeters. The grip portion 252 has a length of 15.5 centimeters. The flexibility length of 3 centimeters is measured from the tapered end of the shock-absorbing body 27 to the bottom end of the cut 261 of the front jacket 26. That is to say that the flexibility length of the shaft 23 is measured from the bottom end of the cut 261 of the front jacket 26. The fixed point of the shaft 23 is therefore located at a point which is 18 centimeters away from the free end of the hand grip 24.

By comparing FIGS. 3 and 4, it is readily apparent that the length of the grip portion 252 of the hand grip 24 of the present invention is increased, and that the fixed point of the shaft 23 is lowered so as to result in an increase in the flexibility length of the shaft 23.

The overall weight of the hand grip 24 of the present invention is reduced, thanks to the slot 254 of the main body 25. In the meantime, the center of gravity is moved toward the head frame 21, thanks to the weight of the shock-absorbing body 27. For this reason, a player will have a better serving or an offensive move by holding the free end of the hand grip 24 in view of the fact that the center of gravity is caused to move toward the head frame 21, and that a greater moment of inertia is made available, and further that the flexibility length of the shaft 23 is increased. On the other hand, when the player is engaged in a defensive move, he or she should hold the portion contiguous to the front jacket 26 so that the center of gravity is located near the portion held by the hand of the player.

What is claimed is:

1. A badminton racket comprising:

a head frame;

a gut located in said head frame;

a shaft of an elongated construction and extending from said head frame in a direction away from said head frame; and a handle of a rodlike construction and having a tapered end fastened with a free end of said shaft, said handle comprising a main body with a grip portion, said main body provided with a tapered end which is fitted over with a front jacket, said main body further provided with an axial hole extending from said tapered end into said grip portion for receiving securely said shaft;

wherein said grip portion of said main body has a length of 15.5 centimeters or more; wherein said main body is provided in an interior thereof with a slot of a predetermined length and extending from a free end of said main body in a direction toward said tapered end of said main body; and wherein said front jacket is provided with a V-shaped cut corresponding in location to a longitudinal center line of said gut to form a receiving space between said front jacket and over said tapered end of said main body, said receiving space intended for accommodating a shock-absorbing body such that a tapered end of a shock-absorbing body and said front jacket form together a tapered end of said handle.

* * * * *